US006269951B1

(12) United States Patent
Hartwig

(10) Patent No.: US 6,269,951 B1
(45) Date of Patent: Aug. 7, 2001

(54) PACKING SYSTEM FOR UNIT LOADS

(75) Inventor: Wolfgang Hartwig, Kamen (DE)

(73) Assignee: Fraunhofer-Gesellschaft zur Forderung der angewandten Forschung e. V., Munich (DE)

( * ) Notice: Subject to any disclaimer, the term of this patent is extended or adjusted under 35 U.S.C. 154(b) by 0 days.

(21) Appl. No.: 09/463,342

(22) PCT Filed: Jul. 22, 1998

(86) PCT No.: PCT/DE98/02060

§ 371 Date: Mar. 14, 2000

§ 102(e) Date: Mar. 14, 2000

(87) PCT Pub. No.: WO99/05043

PCT Pub. Date: Feb. 4, 1999

(30) Foreign Application Priority Data

Jul. 22, 1997 (DE) ..... 197 31 470

(51) Int. Cl.[7] ..... B65D 19/00
(52) U.S. Cl. ..... 206/597; 206/600; 108/56.1
(58) Field of Search ..... 206/386, 597–600, 206/503, 523; 220/1.5; 108/53.1, 55.1, 56.3, 56.1

(56) References Cited

U.S. PATENT DOCUMENTS

| | | | | |
|---|---|---|---|---|
| 3,168,879 | | 2/1965 | Clark . | |
| 3,357,553 | * | 12/1967 | Dick et al. | 206/597 |
| 3,861,326 | | 1/1975 | Brown . | |
| 3,942,654 | * | 3/1976 | Warrick | 206/599 |
| 3,989,140 | * | 11/1976 | Crane | 206/386 |
| 4,079,566 | | 3/1978 | Stoecklin . | |
| 4,127,188 | | 11/1978 | Heaney . | |
| 4,148,394 | * | 4/1979 | Bederman | 206/386 |
| 4,287,991 | | 9/1981 | Donnelly . | |
| 4,913,290 | * | 4/1990 | DeGroot | 206/597 |
| 4,998,619 | * | 3/1991 | Sowa et al. | 206/597 |

FOREIGN PATENT DOCUMENTS

| | | |
|---|---|---|
| 36 27 377 | 2/1988 | (DE) . |
| 89 12 523 | 12/1989 | (DE) . |

* cited by examiner

*Primary Examiner*—Luan K. Bui
(74) *Attorney, Agent, or Firm*—Weingarten, Schurgin, Gagnebin & Hayes LLP

(57) ABSTRACT

The invention relates to a packing system for unit loads which can be stacked in a plurality of adjacent piles or piles stacked on top of each other to form a substantially stable pile consisting of at least two stacked layers of unit loads. The invention is characterized in that spacers are provided between at least two successive stacked layers so that both stacked layers are vertically interspaced; at least one device is provided on top of and below the stack to protect at least partially the external contour of the unit loads located in the top and lower stack position; at least one fixing device encompassing the other periphery of the stack is included so that it encompasses the stack in such a way that the unit loads in a stack position are pressed against the unit loads in a directly and vertically adjacent stack position; and the fixing device extends over the protection device.

13 Claims, 15 Drawing Sheets a)

b)

PACKING SYSTEM FOR UNIT LOADS

Applicant hereby claims priority under 35 U.S.C. 119(a)–(d) based upon prior patent application Ser. No. 197 31 470.8, filed in Germany on Jul. 22, 1997.

BACKGROUND OF THE INVENTION

The invention relates to a packing system for unit loads which can be stacked in a plurality of adjacent piles or piles stacked on top of each other to form a substantially stable pile consisting of at least two stacked layers of unit loads.

The unit loads to be considered are plastic foam boards, used primarily in the construction industry for cushioning or insulation. Typical sizes for these boards for the construction sector are approximately 600 mm wide and approximately 1250 mm and 2500 mm long, due to the standard dimensions established in that sector. The boards are approximately 20 to 200 mm thick, bundled together in packages of between 300 mm and 420 mm in height (predominantly 400 mm). In the specification that follows, reference is made to these dimensions, which are customary in the construction sector, but without restricting the invention to these dimensions.

After production, the packages of foam boards, packaged in shrink film, are bundled together in over-sized units and placed in storage. Deliveries to building materials merchants and construction sites are made using large capacity trucks, with the packages resting on battens or directly on the loading surface (FIG. 1).

At the merchant's premises or the construction site, the products are usually unloaded manually, i.e. the entire load is removed from the cargo space separately package by package. The reasons for this manual unloading procedure are as follows:

While it is true that the packages may be atop battens, special stackers with long prongs or fork attachments are rarely available. The blocks, which it would be possible to unload with long stacker prongs, are too large for internal materials handling. Their height (e.g. 3 m) precludes the possibility of simply commissioning from these large units. In order to remove the uppermost packages from such a block, a ladder or some other form of assistance is needed. The units, as delivered, cannot simply be transferred onto the usual delivery vehicles, whose maximum loading height ranges from approximately 2 to 2.5 m.

The underlying task of the invention is to further refine a packing system for unit loads according to the preamble to claim 1 in such a way that a minimal expenditure of effort for implementing all handling procedures involving the unit loads, from their manufacture to their utilization at the construction site, should be made possible.

SUMMARY OF THE INVENTION

According to the invention, a packing system for unit loads according to the preamble to the main claim is designed in such a way that spacers are provided between at least two successive stacked layers so that both stacked layers are vertically interspaced; at least one device is provided on top of and below the stack to protect at least partially the external contour of the unit loads located in the top and lower stack position; at least one fixing device encompassing the outer periphery of the stack is included so that it encompasses the stack in such a way that the unit loads in a stack position are pressed against the unit loads in a directly and vertically adjacent stack position; and the fixing device extends over the protection device. This method of securing the stack, e.g. wooden laths on the top and bottom and an encircling band with high tensile strength, provides maximum protection of the product and simultaneously a high degree of stability of the unit, because the horizontal forces of the encircling band are absorbed, at the top and the bottom respectively, by the wooden laths, and do not cause the two upper and lower packages to be pressed against each other. Loads on the package edges are likewise eliminated (FIG. 4). The entire unit is subjected only to vertical pressure, such as that in a press. In addition, the wooden boards serve to protect against wear and tear on top of and underneath the unit. High pre-tensioning results in a highly stable loading unit; this guarantees, firstly, good handling properties and, secondly, that there is no relative shifting within the stack, resulting in a decreased risk of damage to the outside edges of the boards. Furthermore, this also creates a relatively unbroken outer profile without protrusions, leading to a further reduction in the risk of damage from being subjected to partial pressures, including pressures from outside. The invention is described in greater detail with reference to the figures below. They show:

DETAILED DESCRIPTION OF THE INVENTION

Figure 1:
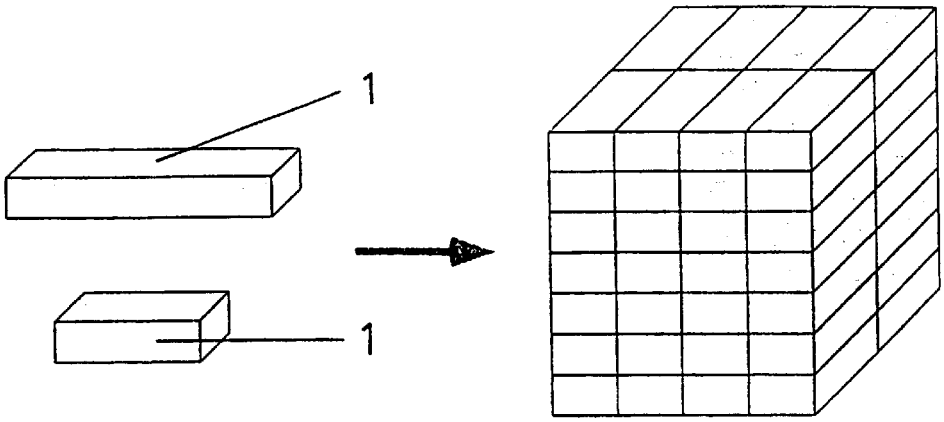
FIG. 1: Examples of loading unit construction and cargo space in a large capacity truck
Figure 1:
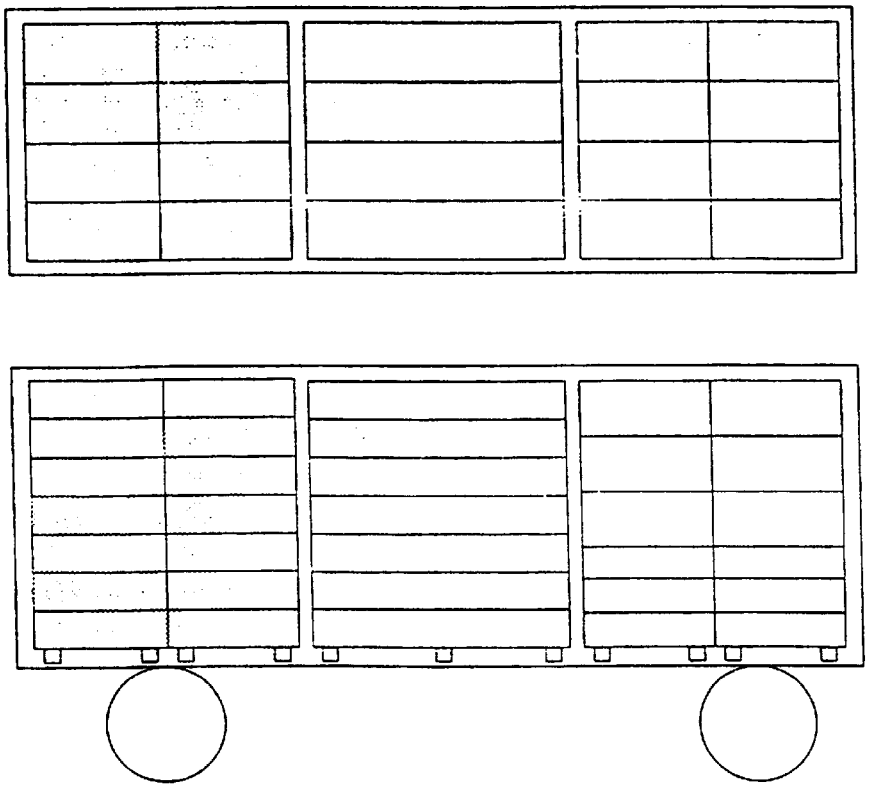
Figure 2:
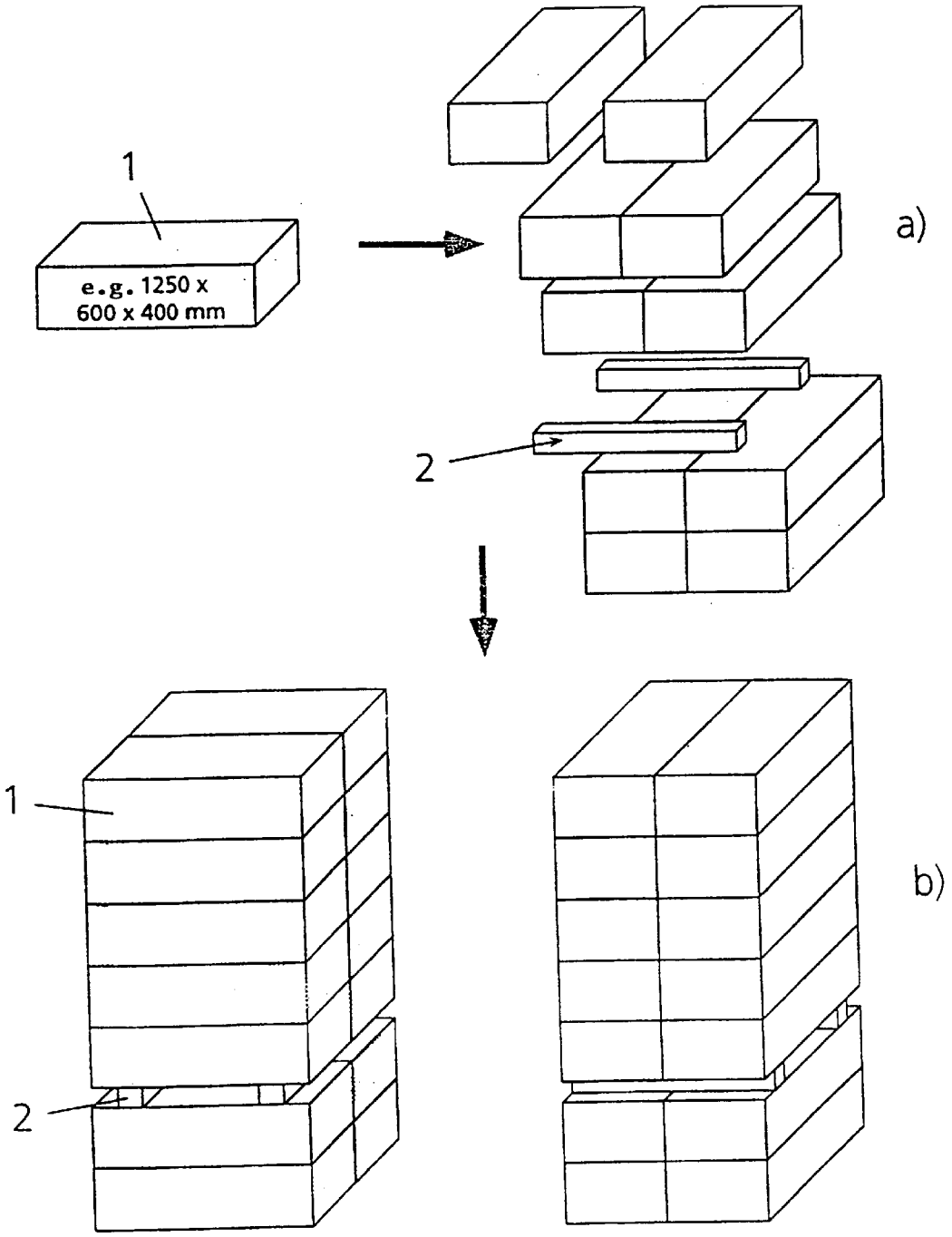
FIG. 2: Stack formation after production
Figure 3:
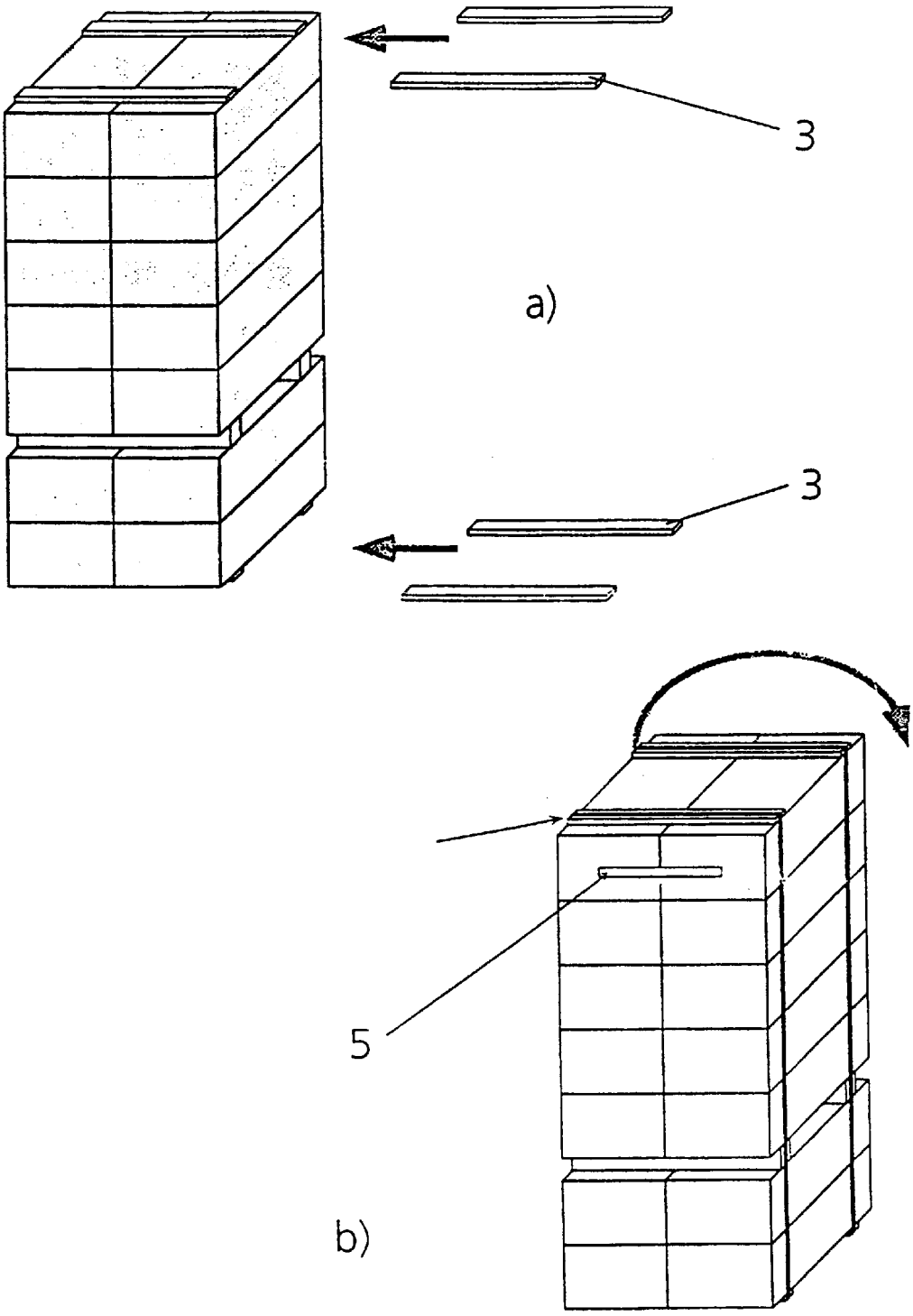
FIG. 3: Method of securing stack
Figure 4:
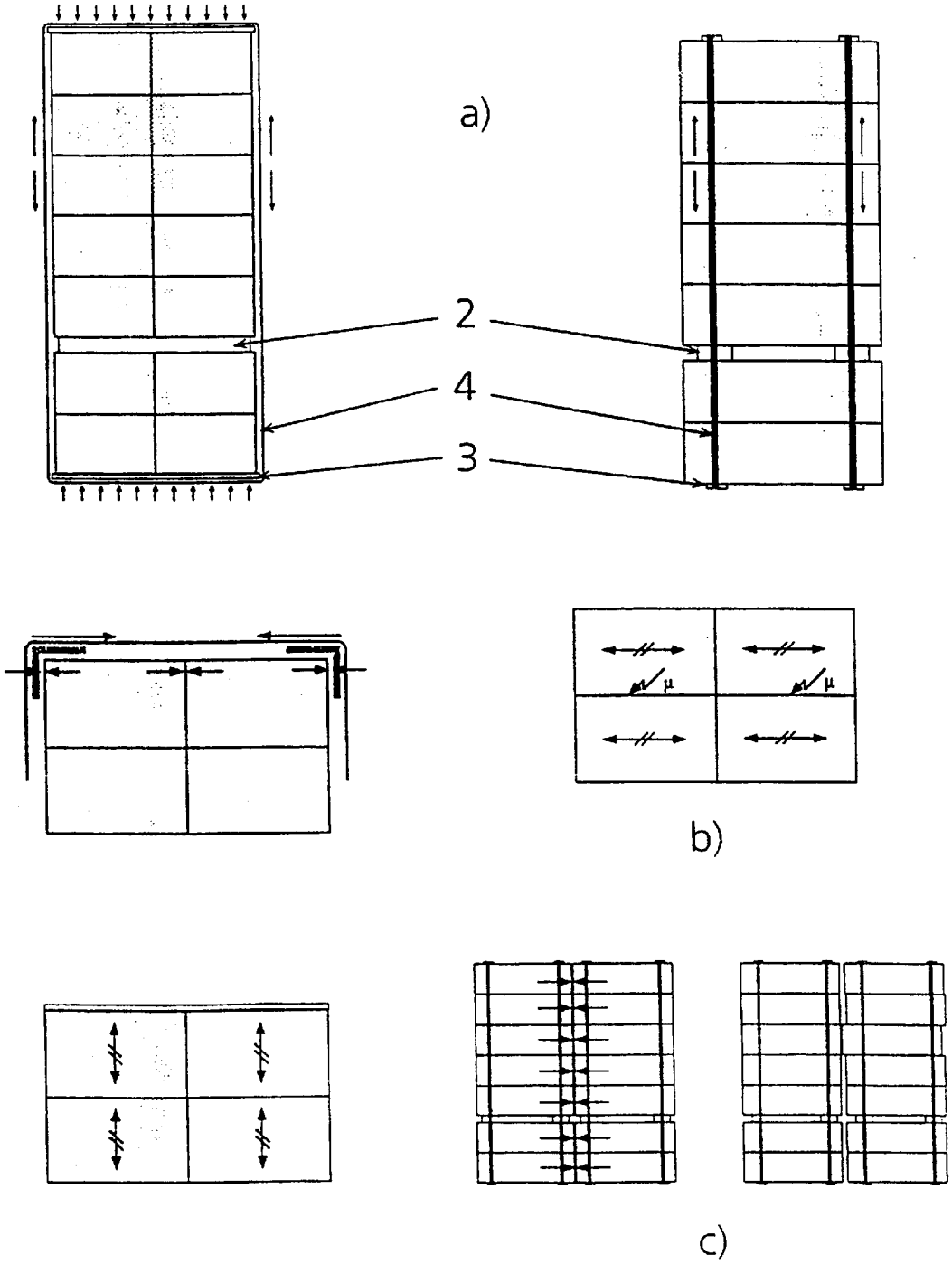
FIG. 4: Existing forces within the stack and mechanical properties

The packages of boards are first made into stacks, where plastic foam battens are inserted after the first two to three layers to separate the layers (FIG. 2). Then, wooden laths are added on top of and beneath the stack, the stack is encircled with a band and, where appropriate, adhesive strips are affixed to the sides facing outward (FIG. 3). The adhesive strips affixed to the sides can serve to hold together the top two package stacks when the encircling band is severed. Given 1.256 m boards, the size of this stack is approximately 1.25×1.2×2.9 m (L×W×H). The wooden laths may also have an indentation for the encircling band.

Figure 5:
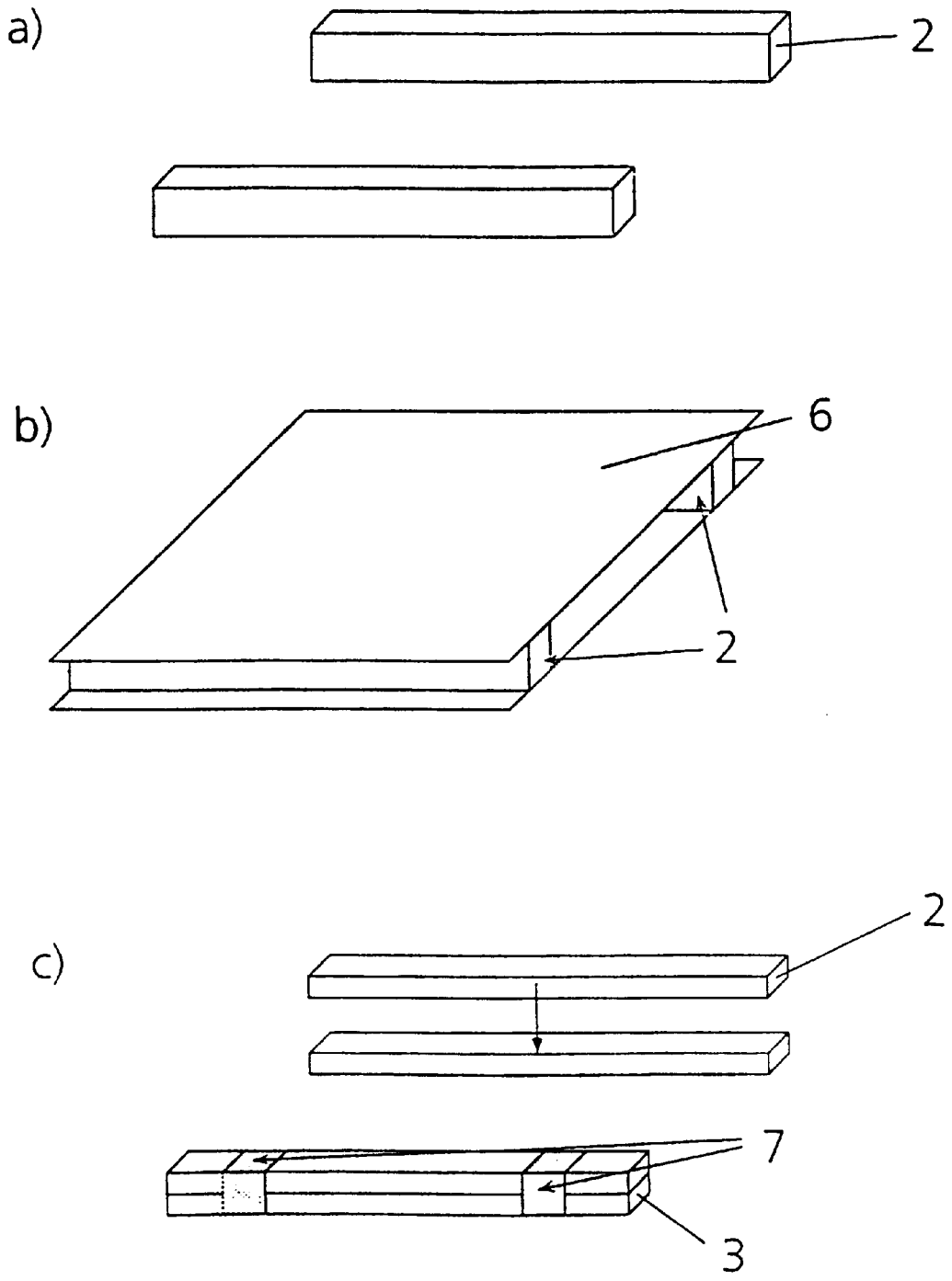
FIG. 5: Alternative versions for intermediate layers

Different options can be used to separate the upper and lower partial stacks (FIG. 5).

1. Foam battens on the upper stack portion, fastened or not,

2. No-return pallets with top and bottom liners made of corrugated cardboard and polystyrene foam battens, and 3. Foam battens made of several layers of polystyrene foam, wherein the thickness of each individual layer is the same as that of the corresponding boards, allowing these materials to be possibly re-used on the construction site.

Figure 6:
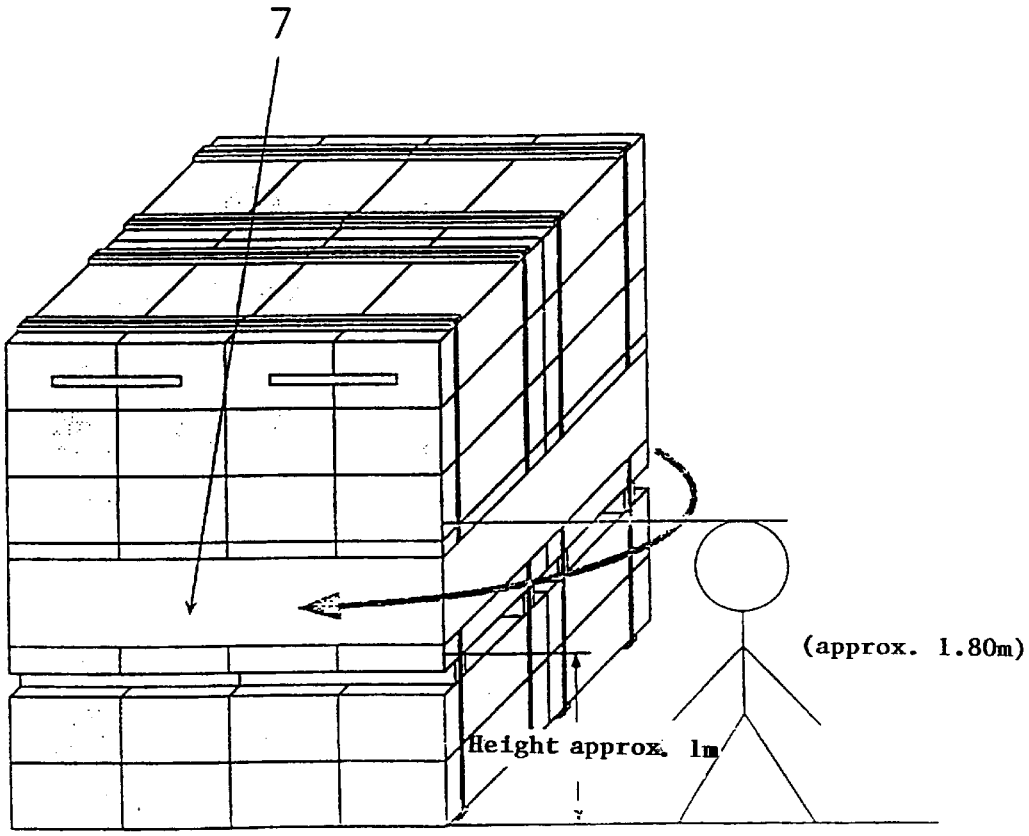
FIG. 6: Bundling stacks together
Figure 6:
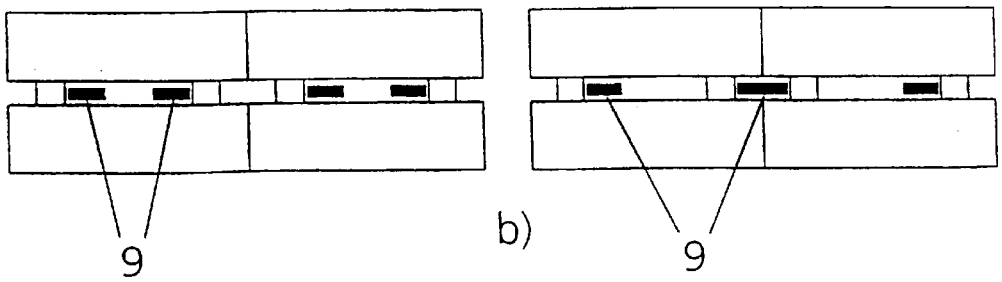
Figure 7:
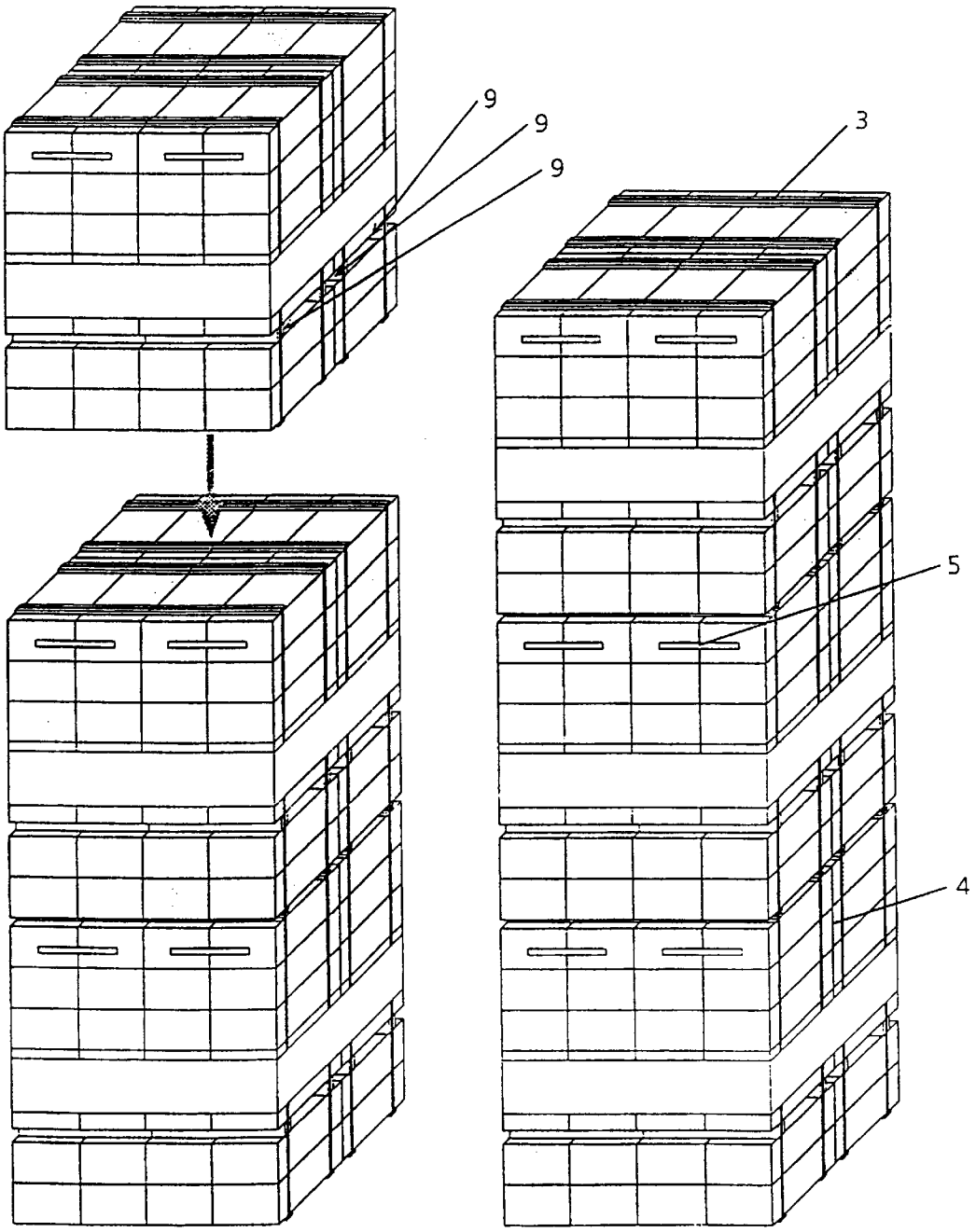
FIG. 7: Storage of blocks

The stacks are then bundled together into a block of four (1.25 m boards) or block of two (2.5 m boards) (FIG. 6) and a means of securing the loading unit is applied (e.g. a wrapper made of stretch film or top and bottom boards). The blocks thus formed are then stacked for storage (FIG. 7).

Figure 8:
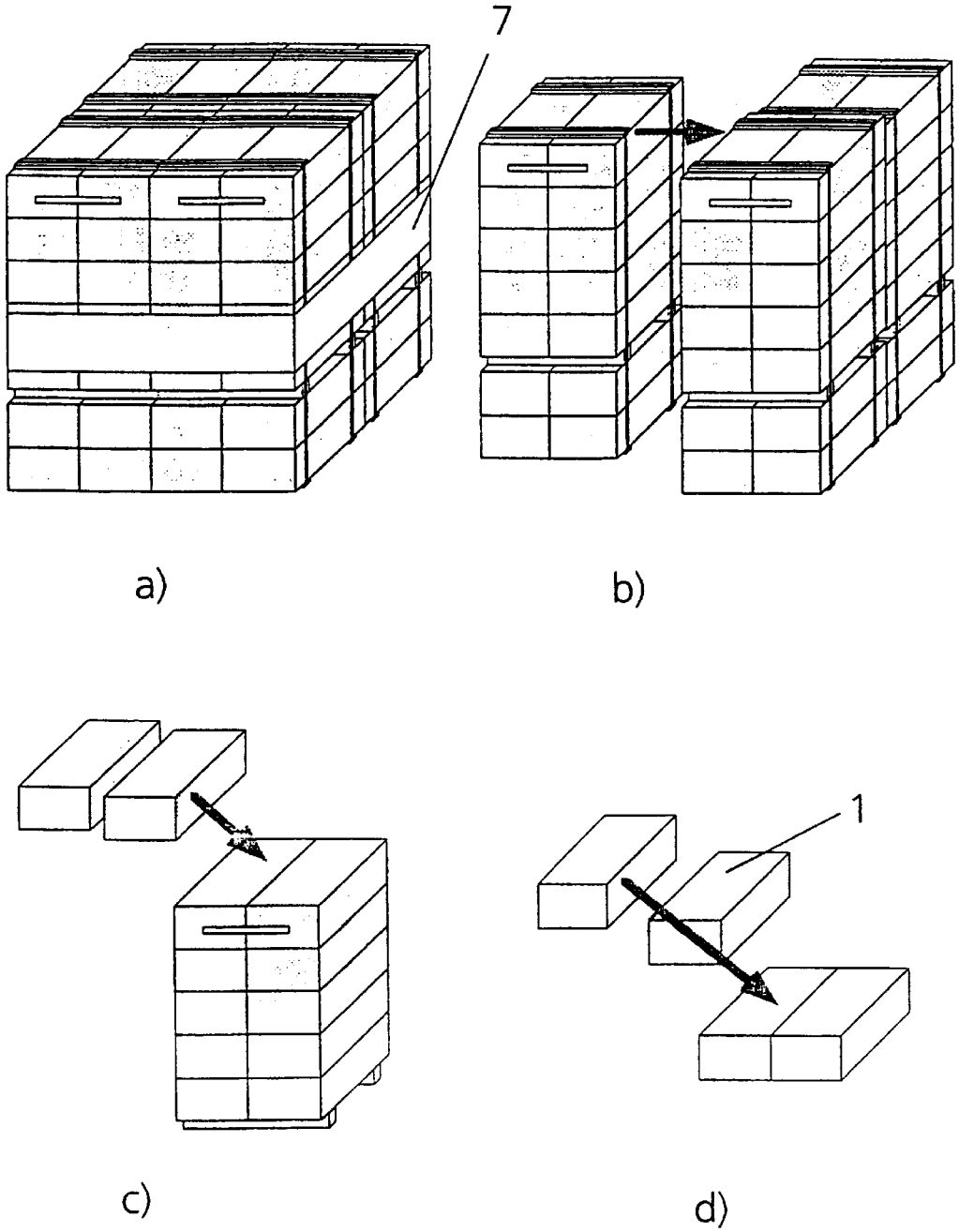
FIG. 8: Commissioning procedures
Figure 9:
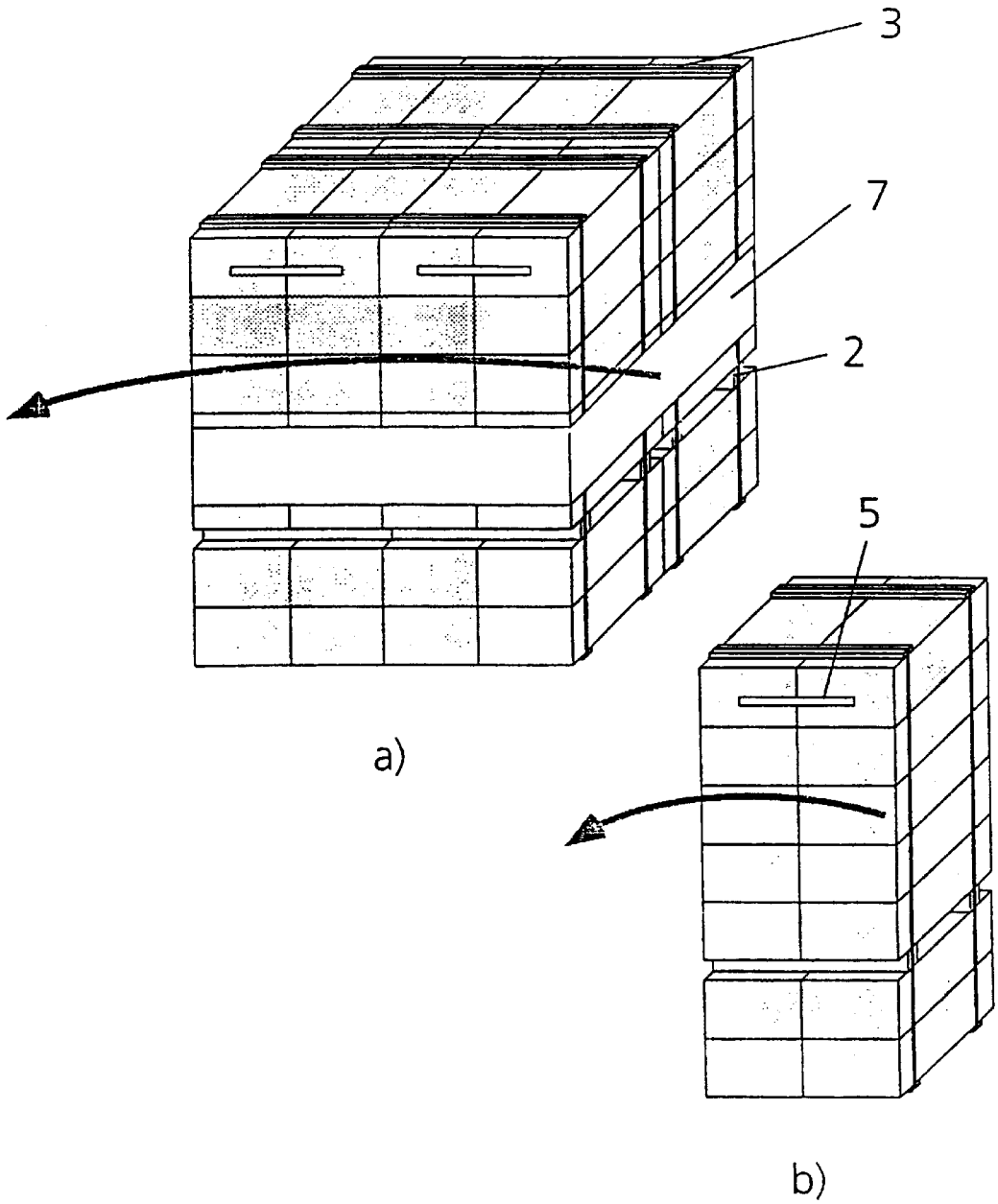
FIG. 9: Loading at manufacturing site
Figure 10:
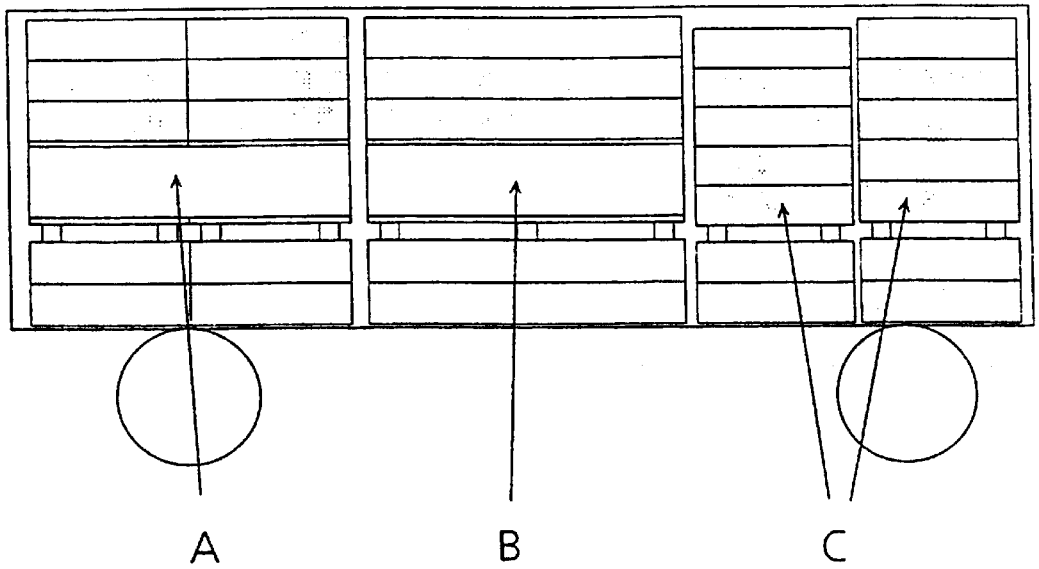
FIG. 10: Arrangement in cargo space
Figure 10:
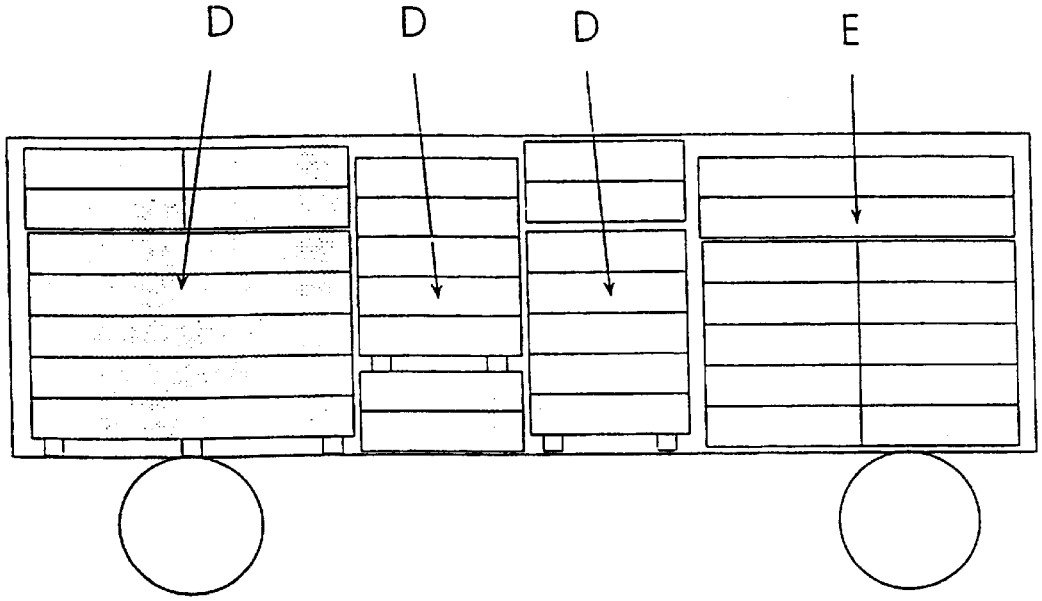
Figure 11:
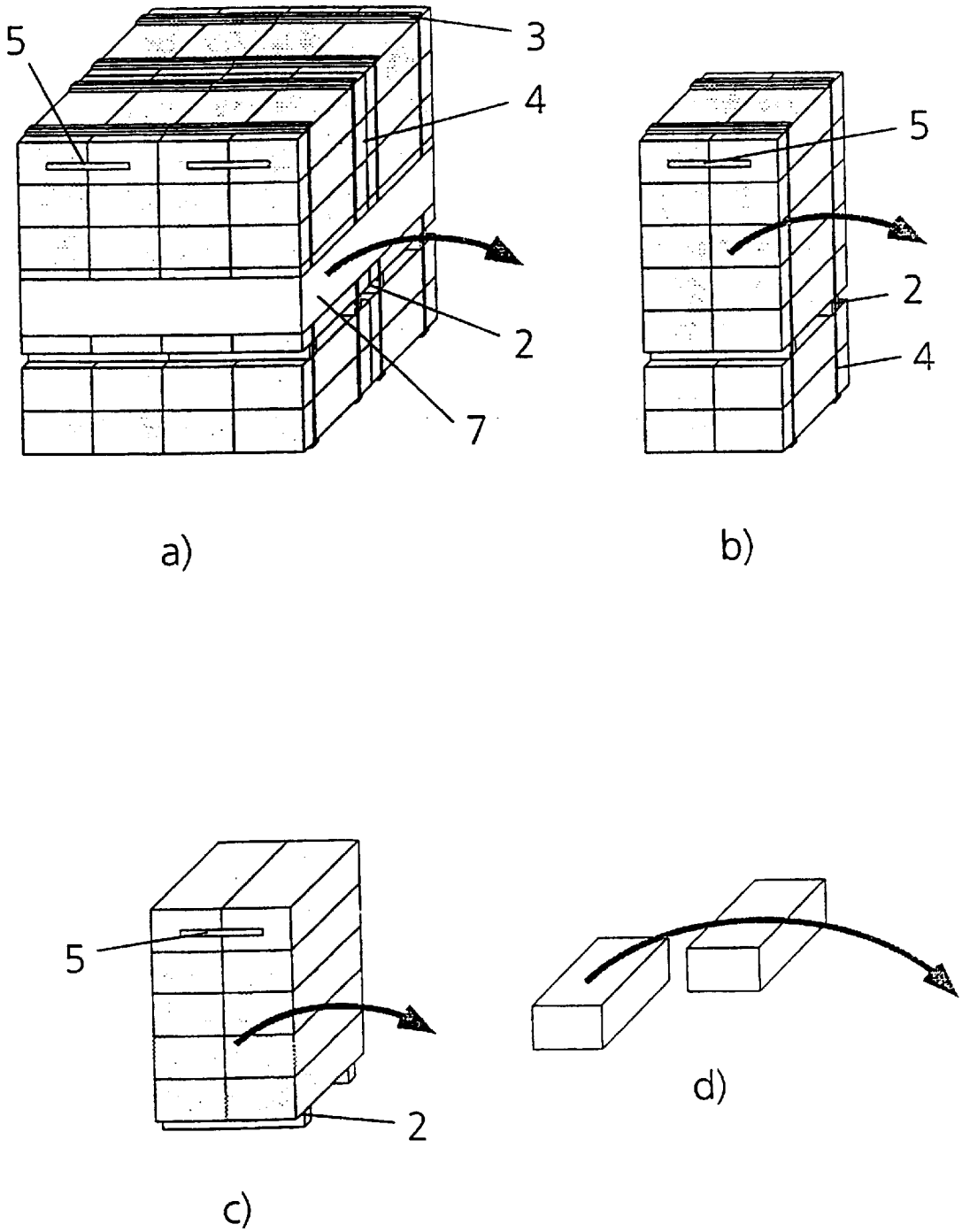
FIG. 11: Unloading at merchant's premises

Individual stacks can then be placed together with different products (FIG. 8) for commissioning. In the case of smaller customer commissions, the individual stacks can also be broken up and, where appropriate, put back together again. It is then possible for the most widely varying unit sizes to be loaded at the manufacturing site (FIG. 9), whereby it is possible to load not only the large units, but individual stacks or even partial stacks (e.g. 4 or 10 packages) as well, using forklifts to do so. The "jumbo" cargo space may then contain large units of 2.4×2.5 m, individual stacks, partial stacks, or individual packages (FIG. 10). On the premises of the building materials merchant, various possibilities exist for unloading the truck (FIG. 11):

1. If long fork attachments are available, large blocks that are 2.4 m deep can be unloaded (it must however be possible to drive in at a uniform height).

2. Individual stacks that are 1.2 m deep can be unloaded using the kind of stackers usually found at building materials merchants. If unloading is done from both sides of the truck, only one stacker with short prongs and one vehicle to drive the stacker are needed. When unloading is done from one side, it is necessary either to use long prongs on the stacker, which can drive in under the rear stacks as well, or there must also be a worker on the cargo surface who pulls the rear stacks up to the unloading edge (the driver can also be called upon to perform this task).

3. Partial stacks or, as in the currently prevailing situation, individual packages can be unloaded, in which case the means used to secure the loading units and stacks must be undone. When stacks with a surface area of 1.2×1.25 m or 1.2×2.5 m (length of board) are being unloaded, internal materials handling and storage pose no problems. All handling procedures are done with the prongs in the spaces between loading units and/or stacks.

Figure 12:
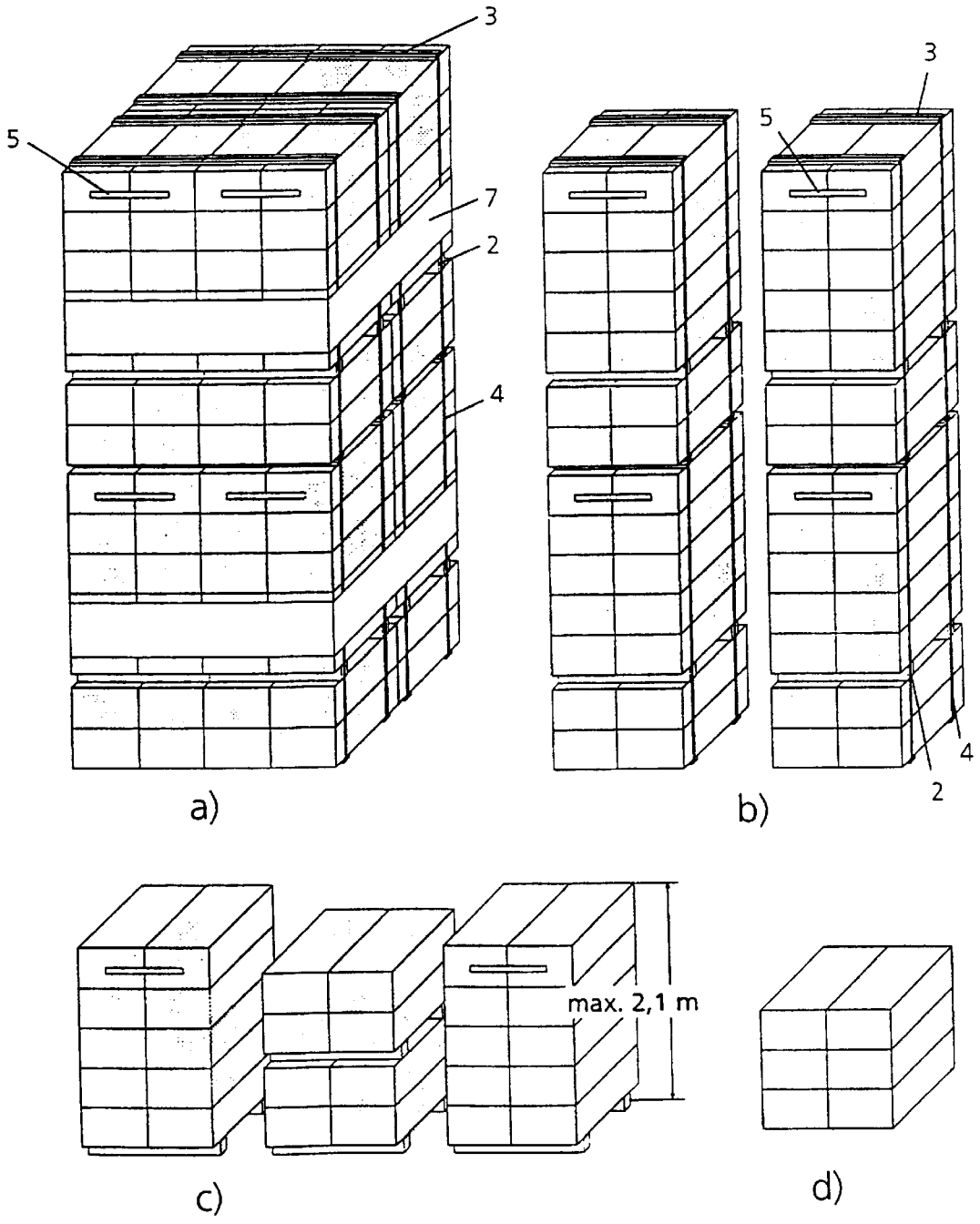
FIG. 12: Storage at building materials merchant
Figure 13:
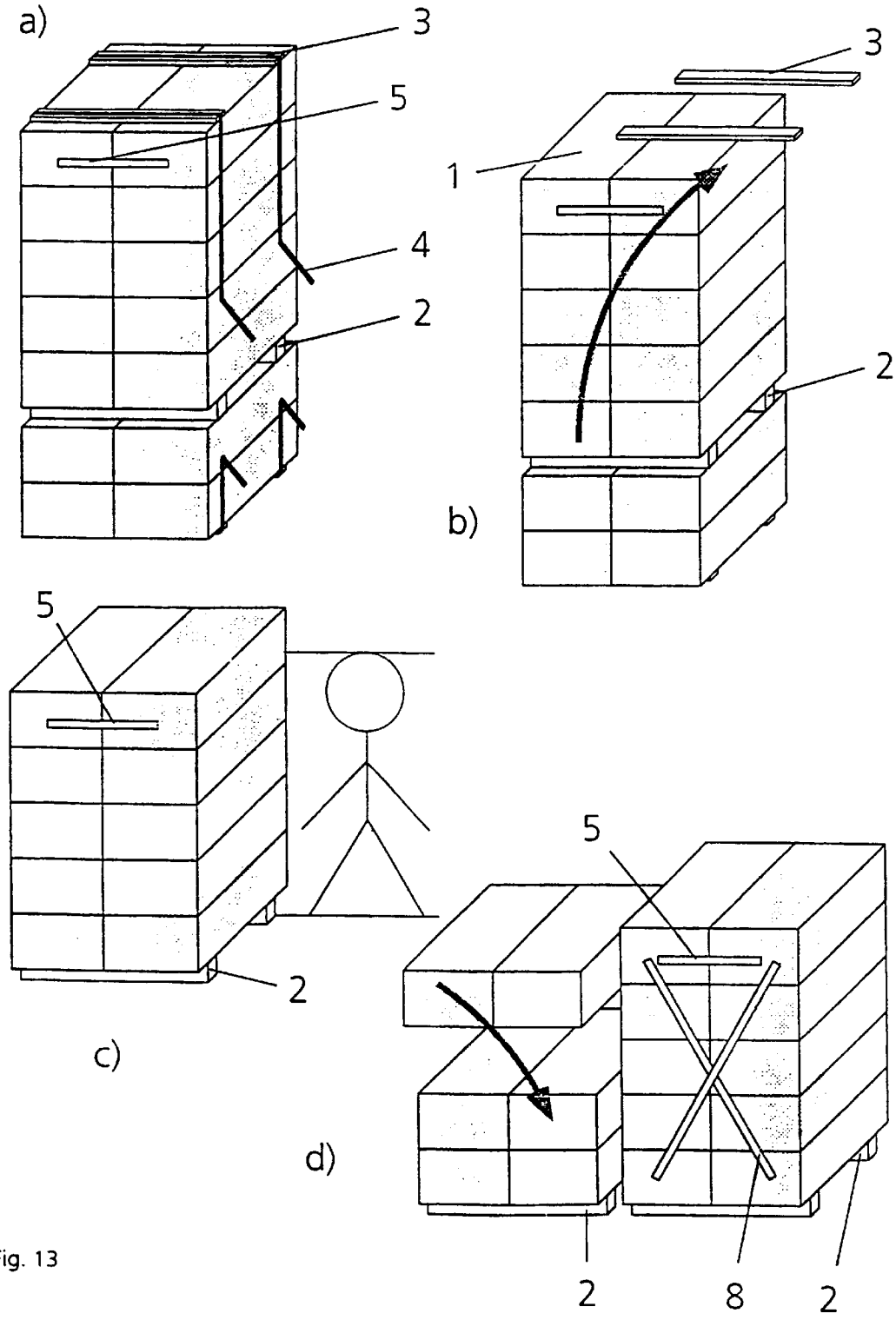
FIG. 13: Commissioning procedures at premises of building materials merchant

The products can be stored in different ways by the building materials merchants (FIG. 12). These include storage of entire blocks, provided the merchant has long prongs at his disposal (this is usually not the preferred method, however, because of difficulty handling the blocks). Another possibility is storage of units having a smaller surface area, including complete stacks, partial stacks, or individual packages. Subsequent commissioning—after the encircling band has been severed—can be done as follows (FIG. 13):

1. The upper stack portion is lifted off, secured where appropriate by additional means such as adhesive tape, and loaded on the building materials truck; the height (2 m) can be transported on this type of vehicle. It is possible, then, for 10 packages, for example, to be on this loading unit.

2. The upper stack portion is lifted off and set down on the ground. The adhesive tape used to secure it is removed (by pulling off or severing), and taking out packages or putting them back together again poses no problem.

3. Both handling methods outlined above can also be applied to the lower stack portion, but if transport by stackers is intended, the entire stack must be set down on top of battens before severing the means by which it is secured.

Figure 14:
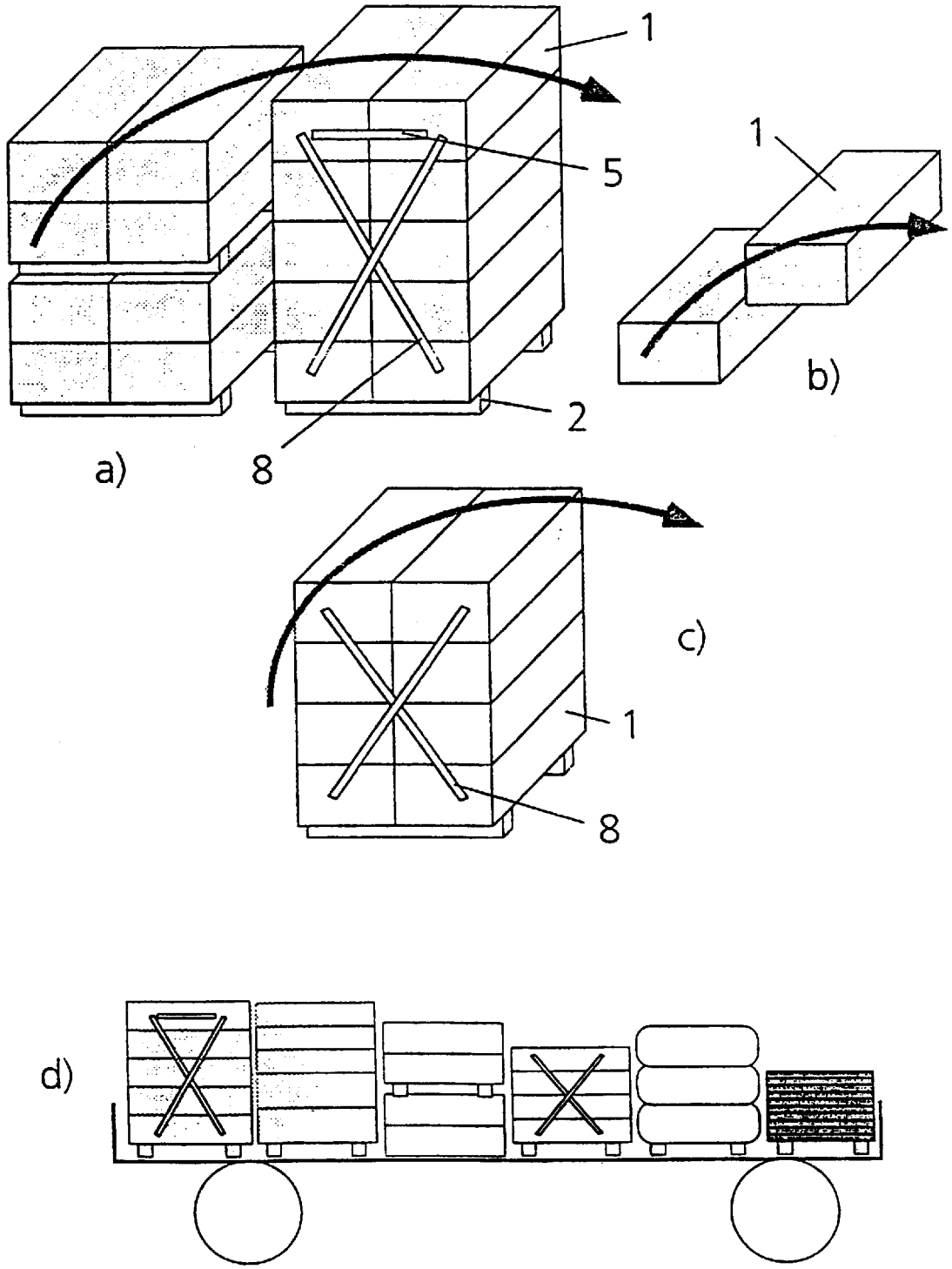
FIG. 14: Loading at premises of building materials merchant and arrangement in cargo space at time of shipping
Figure 15:
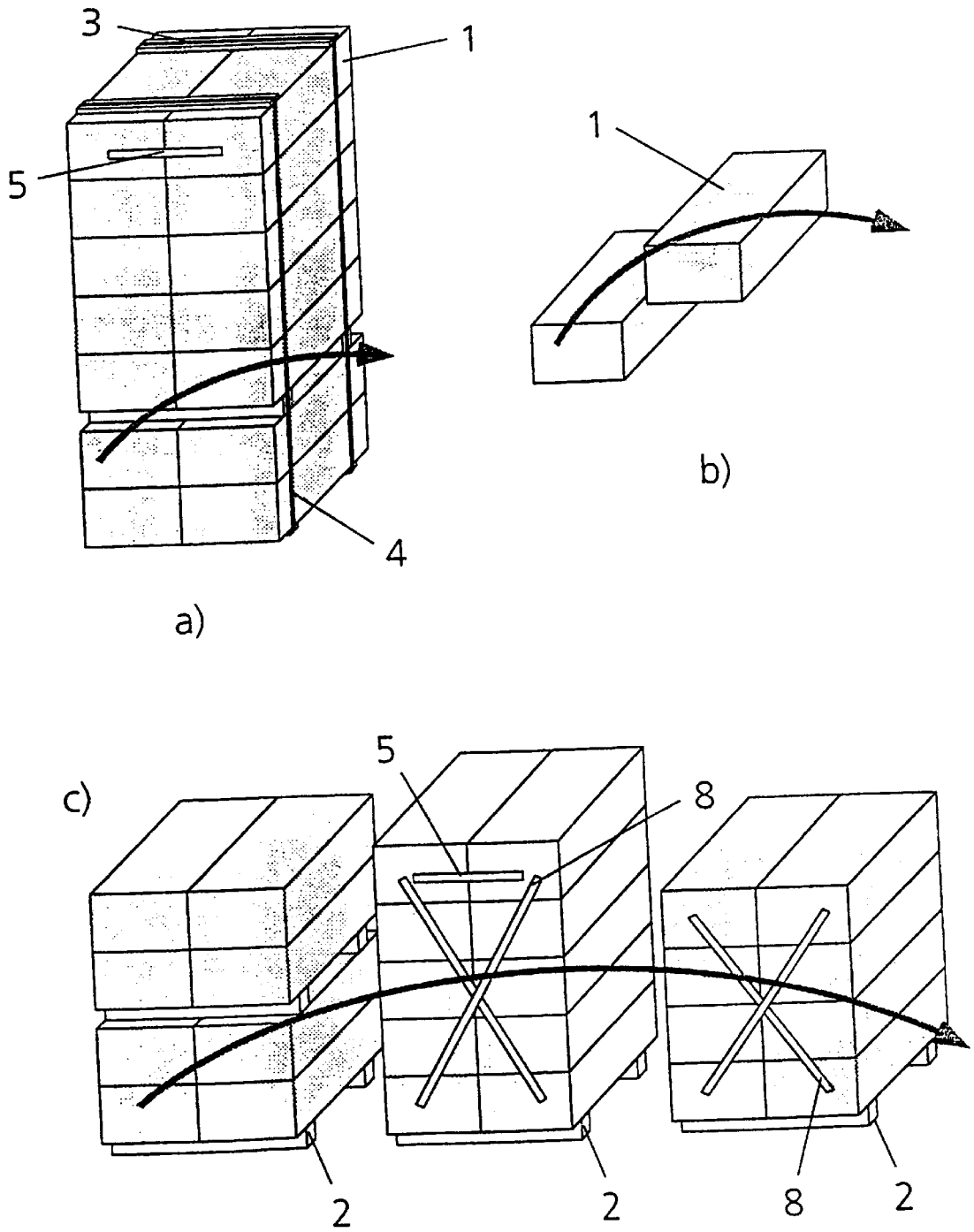
FIG. 15: Unloading at construction site

Thereafter, the vehicles to be used for delivery can be loaded with the aid of a forklift (partial stacks in original condition or stacks that have been put back together again) or, where appropriate, by hand when smaller quantities are involved (FIG. 14). The units can be unloaded at the construction site (provided that the appropriate equipment is available) with the aid of forklifts, hand pallet trucks, or C-frames on a crane (FIG. 15). However, manual unloading remains an option, in which case all means used to secure the loading units must be undone.

All unloading methods can also be used in the case of direct deliveries where there is no merchant acting as intermediary.

The advantages of the system according to the invention are summarized in the following list:

1. Stacker-assisted pre-commissioning at manufacturing site is feasible.

2. Also possible to load smaller units using stacker at manufacturing site (e.g. loading units with surface area of 1.2×1.25 m), requiring less loading time than manual loading.

3. Stacker loading of units measuring 2.4×2.5 m in original condition remains an option (short loading times at manufacturing site).

4. Short unloading times at merchant's premises since stackers can be used to do unloading, even ones with short prongs, provided the wrapper is undone (up to 80% less work required).

5. Very short unloading times at merchant's premises, if stacker with long prongs can be used to carry out the unloading (up to 90% less work required).

6. Forklift can be used to dismantle stack, which means it is easy to reach even uppermost bundles during commissioning (once the upper stacks have been set down on the ground).

7. Relatively easy to move partial stacks on through to the construction site (by splitting up the unit, e.g. into one 2 m and one 0.8 m unit); possible to make three 2 m units out of two 3 m units to fit the building materials truck.

8. Simplified unloading, even at construction site, when appropriate load-shifting equipment is used, both for deliveries where there is a building materials merchant acting as intermediary and for direct deliveries.

9. Simplified handling at the construction site thanks to the ability to grab from below or drive into the loading unit (e.g. by a C-hook on a crane, etc.)

10. Loading unit protected against wear and tear on top and bottom.

11. No load carrier needed for storage purposes (where appropriate, bottom layer to provide protection against moisture).

12. Utilizes no-return component parts that can be re-used by the merchant or on the construction site (wooden laths, EPS battens).

13. No need to return reusable battens or pallet: delivery without pallets.

14. Battens do not scoot out of place in cargo space during transport.

FIG. 1:

a) Example of cargo space in a large-capacity truck with loading height of approximately 3 m (seen from above and side)

FIG. 2:

a) Formation of a stack made of packages from production b) Front and side view of stack

FIG. 3:

a) The wooden laths in the drawing have approximately 5 mm extra length.

b) A stack held together by an encircling band and adhesive tape.

FIG. 4:

a) There is surface weight exerted on the stack via the wooden laths: the pressure has a force of approximately 200 kg per encircling band (total pressure approximately 400 kg). The tensile force in the encircling band in this case is approximately 1000 N.

b) At the edge of the boards on the side of the stack there are no forces resulting from pressure in a horizontal direction, such as those for example when there are angles protecting the edge or when there is no edge protection. High pre-tensioning eliminates horizontal shifting of the packages against one another, resulting in protection for the board edges.

c) High pre-tensioning and continuous laths covering the top and bottom along with continuous foam battens eliminate vertical shifting of the packages against one another, for example during repositioning of the load, which protects the edges of the boards from damage. High pre-tensioning creates fixed position for packages within a stack, and it is possible to make a straight outer profile with no protrusions, leading to lower risk of damage caused by bringing partial pressure to bear.

FIG. 5:

a) Size of the foam battens is approximately 100×100×1200.

b) Size of the no-return pallet, made of corrugated cardboard, is approximately 1200×1250×100.

c) The foam battens are made up of several layers; total height is approximately 100 mm, e.g. 5×20 mm; 4×25 mm; 2×50 mm (can be re-used at the construction site).

FIG. 6:

a) A stack, secured by means of a stretch film wrapper or, where appropriate, boards on top and bottom, or possibly a pallet, that prevent it from falling apart.

b) Opening that will accommodate 3 or 4 stacker prongs

FIG. 8:

a) Putting together whole blocks without severing the wrapper b) Putting together stacks c) Taking apart the stack and putting the stack back together again d) Putting together individual packages

FIG. 9:

a) Loading entire blocks, whether they are in their original condition or have been made by putting stacks together b) Loading of individual stacks FIG. 10: Example of cargo space on a "jumbo" truck, loading height of approximately 3 m a) Unit in original condition made up of 1.25 m boards b) Unit in original condition made up of 2.5 m boards c) Individual stack made up of 1.25 m boards d) Stack which has been taken apart and put back together again e) Individual packages

FIG. 11:

a) Unloading of entire blocks, provided special stackers are available (3 long prongs)

b) Unloading of stacks; wrapper, if any, must first be removed; possible to unload using ordinary stackers (2 short prongs)

c) Unloading of partial stacks d) Unloading of individual packages, after undoing means used to secure the stack, if any

FIG. 12:

a) Storage of entire blocks (3 long prongs)

b) Storage of stacks (2 short prongs)

c) Storage of partial stacks (ready for commissioning, utilizing merchant's own additional battens or loading aids)

d) Storage of individual packages

FIG. 13:

a) Cutting through means used to secure stack b) Lifting off top portion of stack with a forklift and removing the wooden laths c) Commissioning upper and lower portions of stack d) Putting together a new unit. If a partial stack is to be pushed along when the loading surface is free, additional means of securing it may be needed.

FIG. 14:

a) Loading the upper or lower partial stack b) Loading individual packages c) Loading re-commissioned stacks (with additional means used to secure them, where appropriate)

d) Example of cargo space on a delivery truck (loading height of 2 to 2.5 m)

FIG. 15:

a) Unloading a complete stack using a forklift, hand pallet truck, or C-frame on crane hook; used in direct deliveries b) Unloading individual packages; all means of securing must be undone c) Unloading partial stacks using widest variety of methods (forklift, hand pallet truck, C-frame on crane hook, etc.)

List of Reference Symbols

1 Board packages
2 Foam battens
3 Wooden laths
4 Means of securing stack/Encircling band
5 Adhesive tape
6 No-return pallet
7 Wrapper/Stretch film wrapper
8 Additional means of securing
9 Openings for driving in stacker prongs

What is claimed is:

1. Packing system for a plurality of unit loads consisting of plastic foam boards stacked in a plurality of adjacent piles or piles stacked on top of each other to form a substantially stable pile consisting of at least two stacked layers of said unit loads, characterized by the fact that spacers are provided between at least two successive stacked layers so that both stacked layers are vertically disposed and separated by said at least one spacer; at least one protection device is provided on top of and below the stack to protect at least partially the external contour of those of said unit loads positioned at the top and bottom of said stacked layers; at least one fixing device encompassing the outer periphery of the stack so that it encompasses the stack in such a way that said unit loads in a stack position are pressed against said unit loads in a directly and vertically adjacent stack position; and the fixing device extends over the protection device, and wherein the protection device comprises a plurality of multiple, separate, and rectangularly shaped wooden laths, each of said wooden laths separately disposed directly against and along a single dimension of the top and bottom ones of the stacked unit loads, and not extending beyond the edges of the stacked unit loads.

2. Packing system according to claim 1, characterized by the fact that the protection device is embodied in an elongated manner and has a length extending at least from one side of the top or bottom face of the stack to the other.

3. Packing system according to claim 1, characterized by the fact that the fixing device is an encircling band.

4. Packing system according to claim 1, characterized by the fact that the protection device has an indentation into which the fixing device can be laid.

5. Packing system according to claim 1, characterized by the fact that there is at least one adhesive strip affixed to the sides of the unit loads located in the top layer of the stack for the purpose of fixing neighboring unit loads relative to one another.

6. Packing system according to claim 1, characterized by the fact that the spacers are four-sided staves.

7. Packing system according to claim 1, characterized by the fact that the spacers are foam battens.

8. Packing system according to claim 1, characterized by the fact that the spacers are no-return pallets with the top and bottom covered by a layer of corrugated cardboard and battens made of foam.

9. Packing system according to claim 1, characterized by the fact that a stack made up of several stacked layers provides, in the lower part of the stack, spacers to create an intermediate space.

10. Packing system according to claim 1, characterized by the fact that at least two stacks can be put together to form one larger stack, and can be fixed to each other by means of a sort of wrapper that can be put around the sides of the larger stack.

11. Packing system according to claim 10, characterized by the fact that the wrapper is made of stretch film.

12. Packing system according to claim 1, characterized by the fact that there are at least two fixing devices per stack.

13. Packing system according to claim 1, characterized by the fact that:

the fixing device is an encircling band;

the protection device has an indentation into which the fixing device can be laid;

there is at least one adhesive strip affixed to the sides of the unit loads located in the top layer of the stack for the purpose of fixing neighboring unit loads relative to one another;

the spacers are no-return pallets with the top and bottom covered by a layer of corrugated cardboard and battens made of foam;

a stack made up of several stacked layers provides, in the lower part of the stack, spacers to create an intermediate space;

at least two stacks can be put together to form one larger stack, and can be fixed to each other by means of a sort of wrapper that can be put around the sides of the larger stack;

the wrapper is made of stretch film; and there are at least two fixing devices per stack.

* * * * *